US012158051B2

(12) United States Patent
Tilley

(10) Patent No.: US 12,158,051 B2
(45) Date of Patent: Dec. 3, 2024

(54) DRILL STRING CIRCULATION APPARATUS

(71) Applicant: David Jon Tilley, Franklin, LA (US)

(72) Inventor: David Jon Tilley, Franklin, LA (US)

( * ) Notice: Subject to any disclaimer, the term of this patent is extended or adjusted under 35 U.S.C. 154(b) by 776 days.

(21) Appl. No.: 17/271,263

(22) PCT Filed: Aug. 26, 2019

(86) PCT No.: PCT/US2019/048133
§ 371 (c)(1),
(2) Date: Feb. 25, 2021

(87) PCT Pub. No.: WO2020/046810
PCT Pub. Date: Mar. 5, 2020

(65) Prior Publication Data

US 2021/0340835 A1 Nov. 4, 2021

Related U.S. Application Data

(60) Provisional application No. 62/723,445, filed on Aug. 27, 2018.

(51) Int. Cl.
*E21B 33/08* (2006.01)
*E21B 17/07* (2006.01)
*E21B 33/064* (2006.01)

(52) U.S. Cl.
CPC ..... *E21B 33/085* (2013.01); *E21B 17/073* (2013.01); *E21B 33/064* (2013.01)

(58) Field of Classification Search
CPC ..... E21B 33/064; E21B 33/085; E21B 17/073
See application file for complete search history.

(56) References Cited

U.S. PATENT DOCUMENTS

2006/0157253 A1* 7/2006 Robichaux ..... E21B 41/0007 166/359
2011/0005769 A1* 1/2011 Robichaux ..... E21B 33/038 166/386
2017/0321807 A1* 11/2017 Walker ..... E21B 21/02

* cited by examiner

*Primary Examiner* — Kristyn A Hall
(74) *Attorney, Agent, or Firm* — LAW OFFICE OF JESSE D. LAMBERT, LLC

(57) ABSTRACT

A drill string circulation apparatus has a sleeve member with an elongated tubular body and a longitudinal bore, with an outer diameter suitable for being sealingly gripped by a blowout preventer. A drill string has an outer diameter sized to fit within the sleeve member bore, and has one or more seals disposed on an exterior surface. The seals are sized to create a seal between said sleeve member and the drill string, when the drill string and seals are positioned within the sleeve member bore, while said drill string is still capable of reciprocation and/or rotation within the sleeve member when the seals are within the sleeve member bore.

18 Claims, 4 Drawing Sheets

DRILL STRING CIRCULATION APPARATUS

CROSS REFERENCE TO RELATED APPLICATIONS

This patent application claims priority to U.S. provisional patent application Ser. 62/723,445, filed Aug. 27, 2018, for all purposes. The disclosure of that provisional patent application is incorporated herein by reference, to the extent not inconsistent with this application.

BACKGROUND

Field of the Invention

This invention relates to apparatus used in connection with the drilling, completion, and other servicing of oil and gas wells, particularly those drilled from a floating drilling rig. As is known in the art, typically a floating drilling rig (which may be a semi-submersible drilling rig or drill ship) is connected to a blowout preventer assembly positioned on the ocean floor, by a drilling riser. Typically, the blowout preventer assembly comprises several blowout preventers; usually a combination of multiple ram-type blowout preventers with at least two annular blowout preventers on top of the ram-type blowout preventers, making the annular preventers the uppermost blowout preventers.

During certain operations, it is desirable or necessary to form a seal between the drill string and a blowout preventer, for example a subsea annular blowout preventer, while still enabling at least limited longitudinal movement of the drill string in the blowout preventer, and preferably rotation of the drill string. This situation may occur in conventional circulation (i.e., down the bore of the drill string, through the lowermost end of the drill string assembly, and back to the surface through the drill string/borehole/casing annulus; or in "reverse" circulation settings, where the direction of circulation is reversed (i.e. down the drill string/casing/borehole annulus, and up the bore of the drill string). Such circulation settings may involve either drilling or completions fluids.

Known prior art circulation tools generally comprise some form of an outer mandrel gripped and sealed in the blowout preventer downhole, and an inner mandrel which can reciprocate within the length restraints of the inner mandrel within the bore of the outer mandrel, and seals attached to and mounted in the bore of the outer mandrel, forming a pressure/flow seal between the inner and outer mandrels.

The known drill string circulation apparatus all present various issues, giving rise to a desire for an improved circulation apparatus that addresses these issues.

SUMMARY OF THE INVENTION

The drill string circulation apparatus embodying the principles of the present invention comprises an elongated, tubular sleeve member, sized so as to be gripped by an apparatus capable of secure, sealed manner, for example a blowout preventer, for example an annular blowout preventer. The tubular sleeve member has a smooth (e.g. polished) longitudinal bore therethrough. The sleeve member may have one or more upset or enlarged outer diameter sections, for example at one or both ends, to provide positive stops to it moving completely through the blowout preventer. It is understood that when the sleeve member is gripped within the blowout preventer, a pressure/flow seal is formed around the sleeve member. A drill string or section of drill string, which may comprise any form of tubular used in well operations, comprises a plurality of seals disposed on and fixed to the outer surface, in a preferred embodiment forming a plurality of external rings around the drill string. The seals may be affixed to the drill string by molding in place around the drill string, or other suitable methods. The seals may be made of a resilient material, and sized so as to form a sealing or interference fit within the bore of the sleeve member. The seals are preferably spaced longitudinally on the drill string so that at least one, preferably two or more, of the seals will be positioned within the bore of the sleeve member. As can be understood, the seal or seals within the bore of the sleeve member forms a desired pressure/flow seal between the drill string and the annulus between the drill string and the bore of the sleeve member; this in combination with the sleeve member gripped by and sealed with the blowout preventer forms a complete seal to fluid flow. The drill string can still be reciprocated and/or rotated within the sleeve member, with the seals moving within the bore of the sleeve member, while maintaining the seal therein.

DESCRIPTION OF THE PRESENTLY PREFERRED EMBODIMENT(S)

While various apparatus can embody the principles of the present invention, with reference to the drawings some of the presently preferred embodiments can be described.

Figure 1:
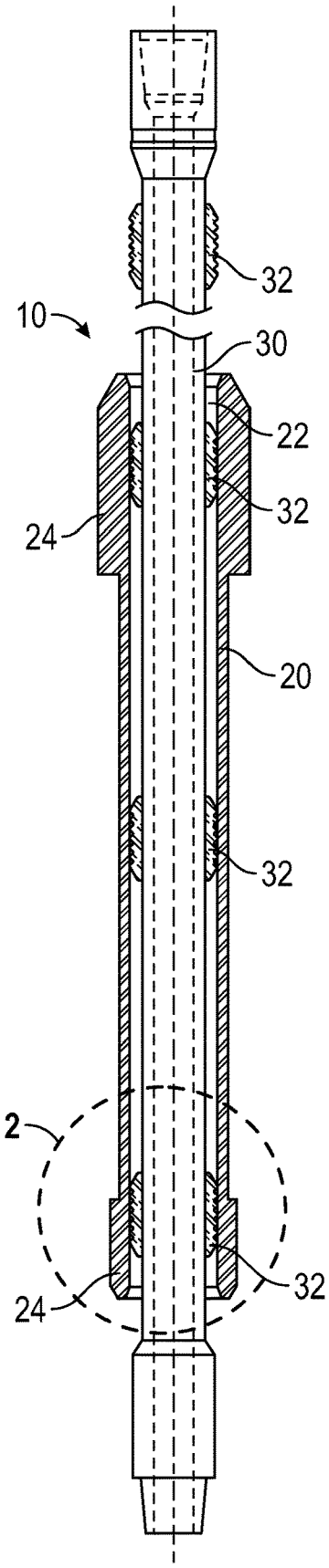
FIG. 1 is a side cross section view of an embodiment of the sleeve member and drill string section with seals thereon, embodying the principles of the present invention.
Figure 3:
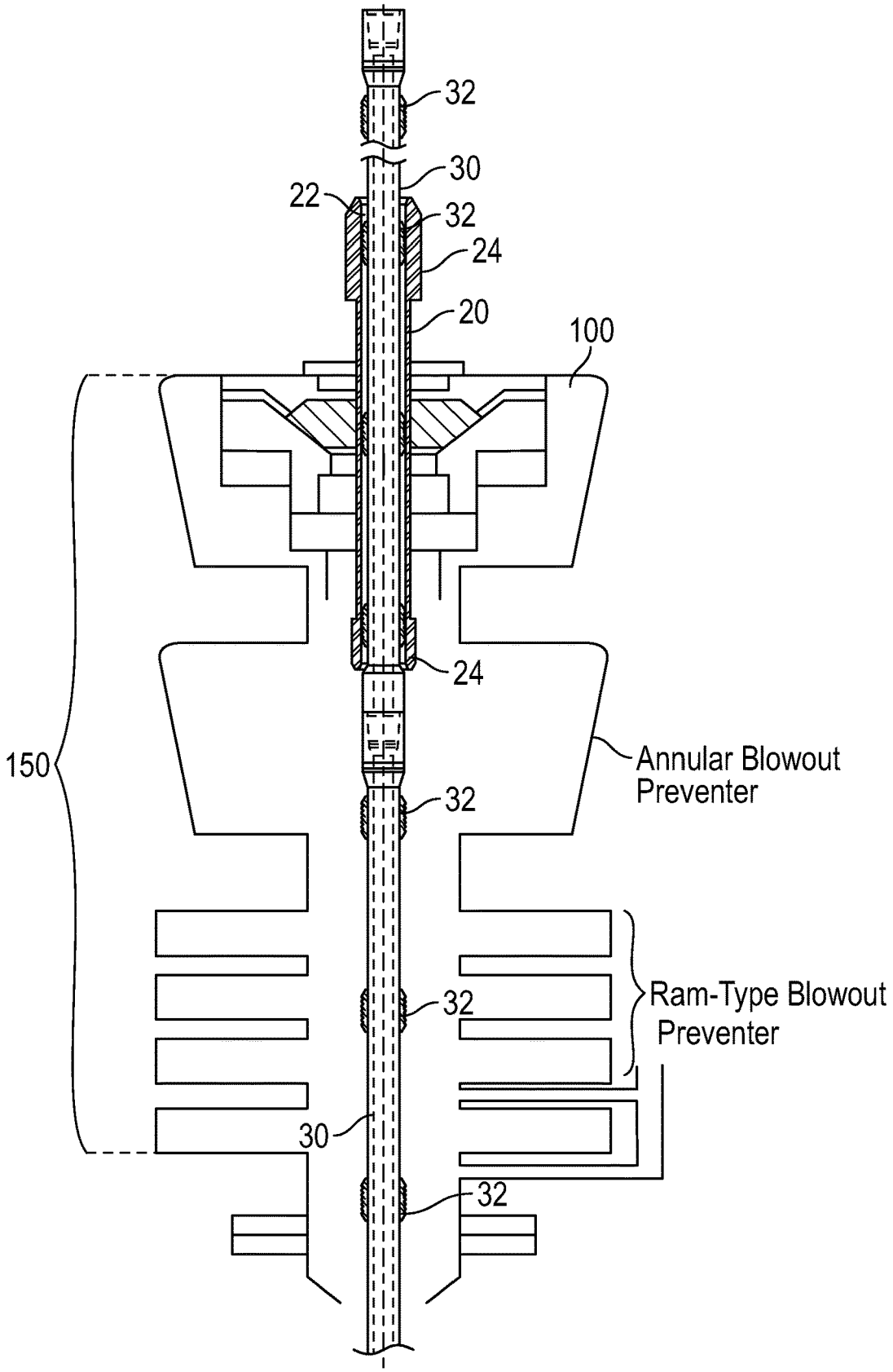
FIG. 3 is a side view of the sleeve member and drill string section with seals thereon, within an exemplary blowout preventer assembly.

FIG. 1 is a side view of an apparatus embodying the principles of the present invention. Drill string circulation apparatus 10 comprises a sleeve member 20, which is an elongated tubular member or body having a longitudinal bore 22 therethrough. Upsets or enlarged outer diameter sections 24 may be provided proximal one or both ends of sleeve member 20, to provide positive stopping of the sleeve member from passage through the blowout preventer. It is understood that the outer diameter of sleeve member 20 is sized so as to be gripped by a blowout preventer, for example an annular blowout preventer 100 (see FIG. 3), with bore 22 preferably being a smooth (e.g. hardened and polished) bore. It is to be understood that upsets or enlarged outer diameter sections 24 may be provided at any location along sleeve member 20. Annular blowout preventer 100 is typically one of the elements in a blowout preventer assembly 150. Blowout preventer assembly 150, as seen in FIG. 3, may comprise two annular blowout preventers atop multiple ram-type blowout preventers.

It is understood that when sleeve member 20 is gripped within the blowout preventer, a pressure/flow seal is formed around sleeve member 20. A section of drill string 30, which may comprise any form or length of tubular used in well operations, comprises a plurality of seals 32 disposed on and fixed to the outer surface thereof, in a preferred embodiment forming a plurality of external rings around drill string 30. Seals 32 may be affixed to drill string 30 by molding around drill string 30, or other suitable means, depending upon the seal material. Seals 32 are preferably made of a resilient material, and sized so as to form a sealing or interference fit within bore 22 of sleeve member 20. Seals 32 are preferably spaced longitudinally on drill string 30 so that at least one, preferably two or more of seals 32 will always be positioned within bore 22 of sleeve member 20. Spacing between adjacent seals 32 should be such that one of such adjacent seals is completely introduced to bore 22 before the other of such adjacent seals exits bore 22.

It is understood that the term "drill string" or "section of drill string," as in drill string 30 is used in a broad sense, and may comprise jointed tubulars commonly known in the industry as "drill pipe," "tubing," "workstring," or any other form of jointed tubulars; or alternatively may comprise coiled tubing or the like. On jointed tubulars, frequently the threaded connection will comprise a section of increased diameter, for example the tool joint on a drill pipe connection. It is understood that the term drill string encompasses tubulars with enlarged threaded connections, as well as "flush joint" or nearly flush joint threaded connections. Drill string is used in its broadest sense to include one or more joints of jointed tubulars, or the entire length of tubular in a well bore.

The diameter of bore 22 and seals 32 are selected so as to yield a suitable sealing or interference fit, to ensure that a seal is formed. By way of example only, bore 22 may be 7.00 inches in diameter, with seals 32 being 7.125 inches in diameter. Where jointed tubulars with upset sections are used as drill string 30, for example tool joint upsets, as can be readily understood the tool joint diameter must be less than the diameter of bore 22 to facilitate working clearance and flow area when required; seals 32 are of necessity larger than the diameter of the tool joints, so as to form the desired seal in 22, while small enough to provide little resistance to fluid flow when seals 32 are out of bore 22 and in well casing. FIG. 3 shows sleeve member 22 gripped by and sealed by blowout preventer 100.

As can be understood, the seal or seals 32 within bore 22 of sleeve member 20 forms a desired pressure/flow seal between drill string 30 and the annulus between drill string 30 and bore 22; this in combination with sleeve member 20 gripped by and sealed with blowout preventer 100 forms a complete seal to fluid flow. Drill string 30 can still be reciprocated within sleeve member 20, with seals 32 moving within bore 22 of sleeve member 20, while maintaining the seal therein. Drill string 30 may be rotated with seals 32 within bore 22, in addition to or in lieu of reciprocation.

Figure 2:
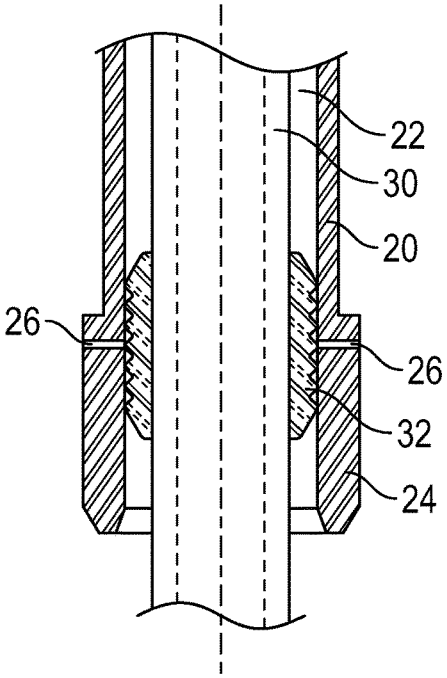
FIG. 2 is an expanded view of a seal affixed to the outer surface of a drill string.

As can be seen in FIG. 2, if desired one or more pressure relief passages 26 may be provided in sleeve member 20, for example in lower upset or enlarged outer diameter section 24, to permit pressure within sleeve member 20 to relieve as lowermost seal 32 passes by pressure relief passages 26. This can aid in preventing seal 32 being pushed off by a pressure differential across it as it exits sleeve member 20. Pressure relief passages 26 permit pressure transmission through the wall of sleeve member 20.

Although a blowout preventer 100 is shown as gripping/sealing around sleeve member 20, in particular an annular blowout preventer, it is understood that any blowout preventer element, e.g. a ram-type blowout preventer, may be used to grip and seal around sleeve member 20. In a broader sense, it is understood that any suitable downhole device may be used to grip and seal around sleeve member 20.

Various seal materials/configurations and methods of attachment to drill string 30 may be used. Urethane is one possible material, and is amenable to molding and comprises temperature capabilities suitable for this application. Alternative materials would include Viton, which is chemical and temperature resistant; FKM (fluoroelastomer), in particular for higher temperature applications; or combinations of molded polymer and removable Viton or Teflon "O" rings, with suitable profiles to retain such O rings in place in the seals. Still other possible materials include elastomers of suitable hardness; and steel or metal seal rings, similar to piston rings, preferably in combination with a polymer seal for leak tightness. The scope of the present invention encompasses any suitable seal material and combinations thereof.

Preferably, seals 32 (and sleeve member 20) are designed to provide a desired pressure differential capability across each seal before relieving, with the sum of the individual pressure differentials yielding the total pressure differential capability.

Different methods of attaching seals 32 to drill string 30 may be used. As mentioned above, molding in place is possible, if desired in combination with post-attachment machining to yield a desired shape. Alternative methods of attaching seals 32 to drill string 30 include bonding, gluing or clamping. Yet another possible alternative is a molded urethane seal fixed on a sand blasted section of drill string, possible with the addition of a molded-in steel sleeve or similar insert (which may be rods parallel to the longitudinal axis) to stop elastic compression and localized "peeling" and "unzipping." Another embodiment would use one type of material to form a retainer for seals 32, which may be of a different material. Another possible material/attachment for seals 32, suitable in certain size combinations, comprises a loose polymer ring fitted and clamped between steel internally tapered collars (that clear the tool joint for installation) that lock seal assembly in place.

In a typical setting, a joint of drill string 30 having seals 32 fixed thereto is positioned within sleeve member 20, while in a shop or similar setting, before being sent offshore to a drilling rig or other setting. The joint of drill string 30 with sleeve member 20 mounted therearound can then be made up into the larger drill string and deployed downhole.

Figure 4:
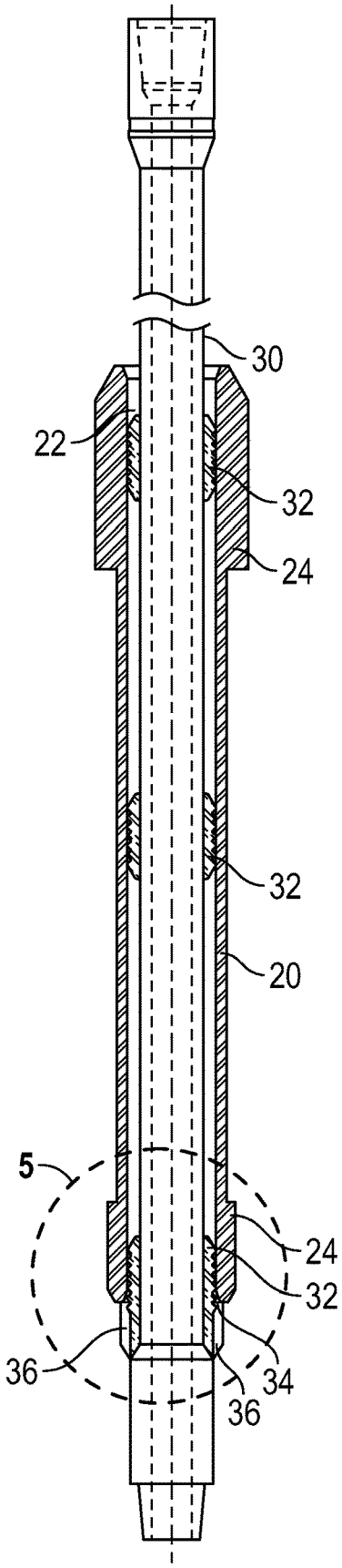
FIG. 4 is a side cross section view of an embodiment of the sleeve member and drill string section with another embodiment of the lowermost seal on the drill string section.
Figure 5:
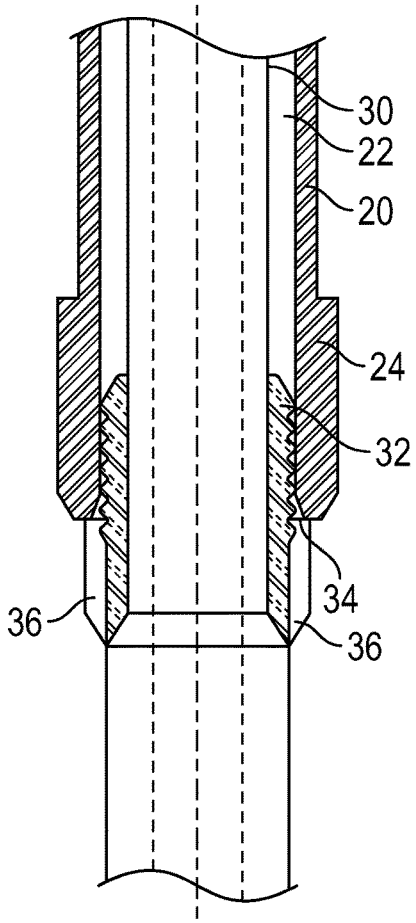
FIG. 5 shows further detail of the apparatus in FIG. 4.

In one preferred embodiment, shown in more detail in FIGS. 4 and 5, one of seals 32, namely the lowermost seal 32 mounted on drill string 30, comprises an enlarged shoulder 34, which has a diameter greater than the diameter of bore 22. In this manner, shoulder 34 acts as a positive stop to movement of sleeve member 20 downwardly past shoulder 34, thereby easing running and positioning sleeve member 20 within annular blowout preventer 100. In this embodiment, lowermost seal 32 preferably comprises flow passages 36, to permit fluid flow around shoulder 34 when lowermost seal 32 is not engaged in bore 22. Alternatively or in addition, a plurality of seals 32 may be positioned relatively close together on drill string 30, so that multiple seals 32 will be positioned within bore 22; the resulting friction force from the multiple seals is sufficient to hold the weight of sleeve member 20 to keep it from moving downwardly on drill string 30, while sleeve member 20 is being run down into position in annular blowout preventer 100. It is understood that any desired length of drill string 30 may be equipped with seals 32. For example, a single section, or several discreet sections each of hundreds of feet in length required for annular sealing at different depths of operation, may be equipped with seals 32.

Another Embodiment

Figure 6:
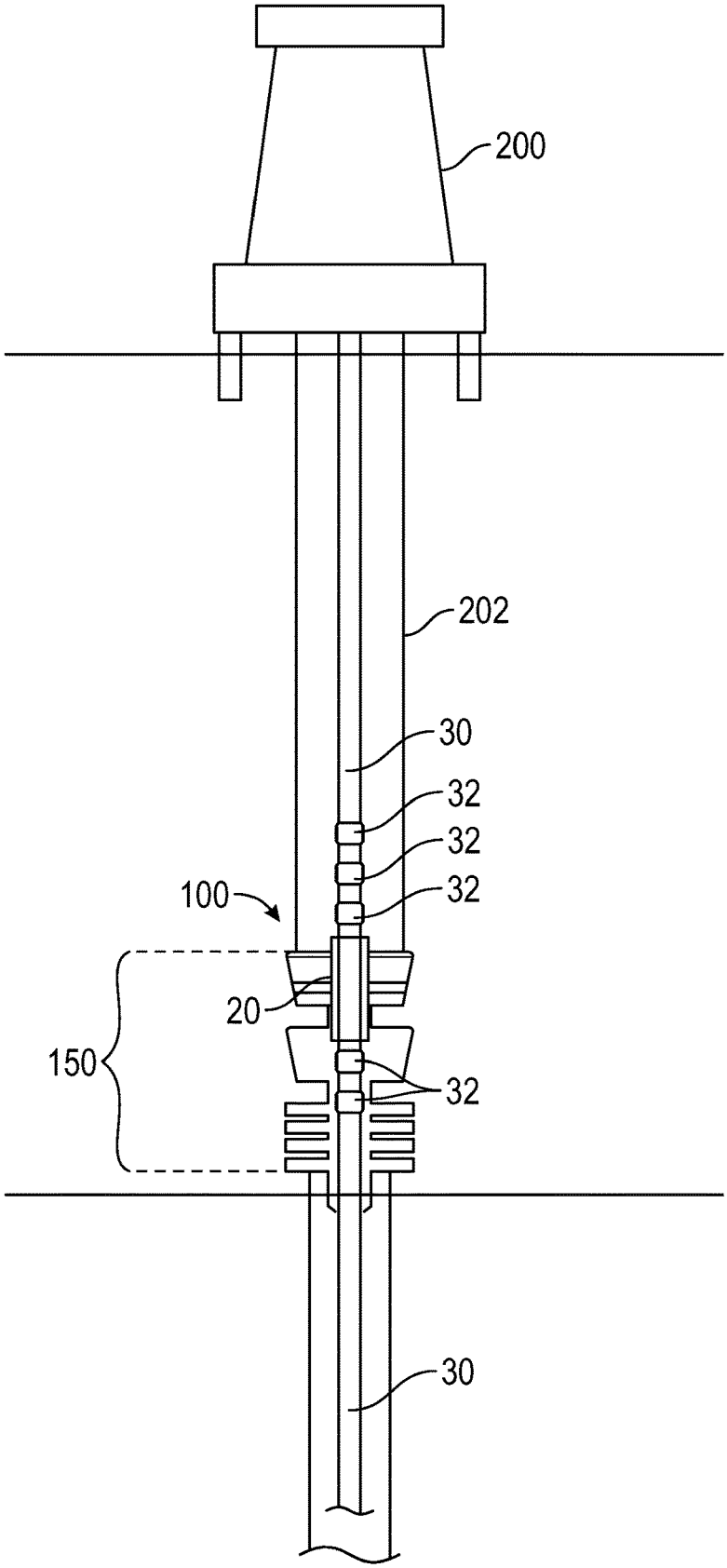
FIG. 6 is an exemplary floating drilling rig and subsea blowout preventer assembly, and showing an embodiment of a wellbore assembly embodying the principles of the present invention.

Another embodiment of the principles of the present invention comprises a wellbore assembly, as an exemplary but not exclusive use of the apparatus. As can be seen in FIG. 6, a floating drilling rig 200 (which may be a semi-submersible drilling rig, drill ship or the like) is connected to a blowout preventer assembly 150 on the sea floor, by a drilling riser 202. Preferably, as previously described, blowout preventer assembly 150 comprises a plurality of blowout preventers having an uppermost blowout preventer. Typically, at least the uppermost blowout preventer is an annular blowout preventer 100. In most blowout preventer assemblies, two stacked annular blowout preventers are provided.

In this exemplary embodiment, sleeve member 20 is sealingly gripped in the uppermost annular blowout preventer 100. As described above, sleeve member 20 preferably comprises an elongated tubular body with a longitudinal bore 22 and having enlarged outer diameter sections or upsets 24 proximal the upper and lower ends. Sleeve member 20 further comprises one or more pressure relief passages 26 in upset 24 proximal a lower end.

The wellbore assembly further comprises a drill string 30 having an outer diameter sized to fit within said sleeve member bore, with a plurality of seals 32 disposed on an exterior surface of the drill string 30. As previously described, seals 32 are sized to create a seal in bore 22 of sleeve member 20 between sleeve member 20 and drill string 30, drill string 30 preferably having two or more of said plurality of seals 32 positioned within sleeve member bore 22. Drill string 30 may be reciprocated and/or rotated with seals 32 within the sleeve member bore 22. Fluid may be circulated in the wellbore while maintaining the seal within the sleeve member.

A Method of Use of the Apparatus

An exemplary use of the apparatus can be described, and will be understood with reference to the foregoing description and the drawings. The sleeve member and seal-equipped drill string provides a method of sealing around a drill string to enable controlled fluid circulation in a borehole, while retaining the ability of the drill string to be reciprocated and rotated within said borehole. Sleeve member 20 comprises an elongated tubular body with a longitudinal bore 22 therethrough, and an outer diameter suitable for being sealingly gripped by a blowout preventer 100. A drill string 30 has an outer diameter sized to fit within sleeve member bore 22, and comprises one or more seals 32 disposed on an exterior surface, seals 32 sized to create a seal between sleeve member 20 and drill string 30 when drill string 30 and seals 32 are positioned within sleeve member bore 22. It is understood that drill string 30 is still capable of movement within sleeve member 20 when seals 32 are within sleeve member bore 22. Sleeve member 20 is positioned within a blowout preventer assembly 150, typically comprising two or more annular blowout preventers, such that said sleeve member is positioned within and sealingly gripped by the uppermost of said two or more annular blowout preventers, for example annular blowout preventer 100. Preferably, sleeve member 20 does not extend below (in a downhole direction) the uppermost annular blowout preventer; in this manner, all other blowout preventers in the blowout preventer assembly (which typically includes a second annular blowout preventer and multiple ram-type blowout preventers) remain fully functional.

The method of use further comprises sealingly gripping sleeve member 20 with annular blowout preventer 100, and positioning drill string 30 so that two or more seals 32 are positioned within bore 22 of sleeve member 20. Fluid may then be circulated in the wellbore, whether reverse circulating (that is, pumping fluid downhole in the annulus between the drill string and the casing/borehole, and back uphole through the drill string bore) or conventional circulating, namely pumping downhole through the drill string bore and back up the annulus, as is well known in the art. A fluid seal is maintained around drill string 30 in sleeve member 20. The method of use may further comprise reciprocating and/or rotating drill string 30, as desired.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, dimensions of the sleeve member and drill string seals can be varied to suit particular settings; materials, particularly for the seals, may be varied; seal spacing on the drill string may be varied so as to have a desired number of seals positioned within the sleeve member at any one time; the seals may be made from different materials; varying lengths or sections of the drill string may be equipped with seals, so as to permit relatively rapid deployment of sleeve member 20 around the drill string then downhole to be gripped by the blowout preventer. The apparatus may be used in connection with offshore drilling and well servicing operations from both floating and grounded drilling rigs, and may be used in connection with onshore operations.

Therefore, the scope of the invention is to be determined not by the illustrative examples set forth above, but by the appended claims and their legal equivalents.

I claim:

1. A drill string circulation apparatus, comprising:

a sleeve member comprising an elongated tubular body with a longitudinal bore therethrough, said sleeve member comprising an outer diameter suitable for being sealingly gripped by a blowout preventer;

a drill string having an outer diameter sized to fit within said sleeve member bore, said drill string comprising one or more seals disposed on and attached to an exterior surface thereof, such that said seals move with said drill string, said seals sized to create a seal between a wall of said bore of said sleeve member and said exterior surface of said drill string, when said drill string and said one or more seals are positioned within said sleeve member bore, while said drill string is still capable of movement within said sleeve member when said seals are within said sleeve member bore.

2. The drill string circulation apparatus of claim 1, wherein said sleeve member comprises one or more enlarged outer diameter sections.

3. The drill string circulation apparatus of claim 2, wherein said one or more enlarged outer diameter sections comprise two spaced-apart enlarged outer diameter sections.

4. The drill string circulation apparatus of claim 1, wherein said sleeve member comprises pressure relief passages proximal a downhole end, said pressure relief passages permitting pressure transmission through a wall of said sleeve member.

5. The drill string circulation apparatus of claim 1, wherein a seal on said sleeve member comprises a portion having an outer diameter larger than the diameter of said bore of said sleeve member, and wherein said seal further comprises one or more flow passages formed in said larger outer diameter portion.

6. The drill string circulation apparatus of claim 1, wherein said one or more seals comprises two or more seals disposed on said drill string, said two or more seals spaced apart on said drill string so as that at least two of said seals are positioned within said sleeve member bore.

7. The drill string circulation apparatus of claim 1, wherein said one or more seals are formed from a material selected from the group consisting of urethane, polyurethane, Viton, and fluoroelastomers.

8. The drill string circulation apparatus of claim 1, wherein said one or more seals comprise a molded polymer base and one or more O-rings held in said base.

9. The drill string circulation apparatus of claim 1, wherein said one or more seals are attached to said drill string by molding, bonding, gluing or clamping said seals on said drill string.

10. A drill string circulation apparatus, comprising:

a sleeve member comprising an elongated tubular body with a longitudinal bore therethrough, said sleeve member comprising an outer diameter suitable for being sealingly gripped by a blowout preventer and having enlarged outer diameter sections proximal the upper and lower ends thereof, said sleeve member further comprising one or more pressure relief passages in said enlarged outer diameter section proximal said lower end;

a drill string having an outer diameter sized to fit within said sleeve member bore, said drill string comprising one or more seals disposed on and attached to an exterior surface thereof, such that said seals move with said drill string, said seals sized to create a seal in said bore of said sleeve member between a wall of said bore of said sleeve member and said exterior surface of said drill string, when said drill string and said one or more seals are positioned within said sleeve member bore, while said drill string is still capable of movement within said sleeve member when said seals are within said sleeve member bore.

11. The drill string circulation apparatus of claim 10, wherein a seal on said sleeve member comprises a shoulder having an outer diameter larger than the diameter of said bore of said sleeve member, and wherein said seal further comprises one or more flow passages formed in said larger outer diameter portion.

12. A method of sealing around a drill string to enable controlled fluid circulation in a borehole, while retaining the ability of the drill string to be reciprocated and rotated within said borehole, comprising the steps of:

a) providing an apparatus comprising:

a sleeve member comprising an elongated tubular body with a longitudinal bore therethrough, said sleeve member comprising an outer diameter suitable for being sealingly gripped by a blowout preventer; and a drill string having an outer diameter sized to fit within said sleeve member bore, said drill string comprising one or more seals disposed on and attached to an exterior surface thereof, such that said seals move with said drill string, said seals sized to create a seal between a wall of said bore of said sleeve member and said exterior surface of said drill string, when said drill string and said one or more seals are positioned within said sleeve member bore, while said drill string is still capable of movement within said sleeve member when said seals are within said sleeve member bore;

b) positioning said apparatus in a blowout preventer assembly comprising two or more annular blowout preventers, such that said sleeve member is positioned within and sealingly gripped by the uppermost of said two or more annular blowout preventers;

c) sealingly gripping said sleeve member with said uppermost annular blowout preventer; and d) positioning said drill string so that two or more seals are positioned within said bore of said sleeve member.

13. The method of claim 12, further comprising the step of:

e) circulating fluid in said wellbore.

14. The method of claim 13, further comprising the step of:

f) reciprocating said drill string.

15. The method of claim 14, further comprising the step of:

g) rotating said drill string.

16. A wellbore assembly, comprising:

a blowout preventer assembly comprising a plurality of blowout preventers having an uppermost blowout preventer;

a sleeve member sealingly gripped in said uppermost blowout preventer, said sleeve member comprising an elongated tubular body with a longitudinal bore therethrough and having enlarged outer diameter sections proximal the upper and lower ends thereof, said sleeve member further comprising one or more pressure relief passages in said enlarged outer diameter section proximal said lower end; and a drill string having an outer diameter sized to fit within said sleeve member bore, said drill string comprising a plurality of seals disposed on and attached to an exterior surface thereof, such that said seals move with said drill string, said seals sized to create a seal in said bore of said sleeve member between a wall of said bore of said sleeve member and said exterior surface of said drill string, said drill string and two or more of said plurality of seals positioned within said sleeve member bore.

17. The wellbore assembly of claim 16, further comprising a drilling riser extending from said blowout preventer assembly to a drilling rig.

18. The wellbore assembly of claim 17, wherein a seal on said sleeve member comprises a shoulder having an outer diameter larger than the diameter of said bore of said sleeve member, and wherein said seal further comprises one or more flow passages formed in said larger outer diameter portion.

* * * * *